US007728237B2

(12) United States Patent
Pedersen et al.

(10) Patent No.: US 7,728,237 B2
(45) Date of Patent: Jun. 1, 2010

(54) MULTI-FUNCTIONAL CONTROL

(75) Inventors: Gerner Pedersen, Lille Skensved (DK); Robert J. Stinauer, Arlington Heights, IL (US)

(73) Assignee: Sonion A/S, Roskilde (DK)

( * ) Notice: Subject to any disclaimer, the term of this patent is extended or adjusted under 35 U.S.C. 154(b) by 383 days.

(21) Appl. No.: 11/796,859

(22) Filed: Apr. 30, 2007

(65) Prior Publication Data

US 2007/0256919 A1 Nov. 8, 2007

Related U.S. Application Data

(60) Provisional application No. 60/796,397, filed on May 1, 2006.

(51) Int. Cl.
*H01H 21/00* (2006.01)

(52) U.S. Cl. ..... 200/11 R; 200/19.18

(58) Field of Classification Search ..... 200/1 R, 200/1 B, 411 R, 11 K, 11 E, 11 EA, 11 TC, 200/17 R, 18, 19.07, 19.18, 61.39, 336, 564, 200/572

See application file for complete search history.

(56) References Cited

U.S. PATENT DOCUMENTS

| | | | | |
|---|---|---|---|---|
| 5,380,965 | A | 1/1995 | Møller | 200/11 |
| 5,711,415 | A | 1/1998 | Fukuda et al. | 200/570 |
| 6,124,558 | A * | 9/2000 | Baumeister et al. | 200/501 |
| 6,396,016 | B1 | 5/2002 | Lin et al. | |
| 6,943,308 | B2 * | 9/2005 | Ravnkilde et al. | 200/200 |
| 7,012,200 | B2 * | 3/2006 | Moller | 200/11 A |
| 7,439,458 | B2 * | 10/2008 | Montalvo | 200/4 |

FOREIGN PATENT DOCUMENTS

| | | | |
|---|---|---|---|
| DK | 168258 | B1 | 2/1994 |
| EP | 0 724 278 | A2 | 7/1996 |
| EP | 1 455 370 | A1 | 9/2004 |

OTHER PUBLICATIONS

European Search Report dated Jun. 25, 2009 for Application No. 07 10 6981.

* cited by examiner

*Primary Examiner*—Renee S Luebke
*Assistant Examiner*—Marina Fishman
(74) *Attorney, Agent, or Firm*—Nixon Peabody LLP

(57) ABSTRACT

A multifunctional switch and impulse generator assembly are disclosed that include a fixed base part enclosing an electrical pulse generator. A rotatable upper part with an actuation knob is included. The electrical pulse generator is adapted to provide electrical pulses on one or more externally accessible terminals in response to clockwise and/or counterclockwise rotary motion of the actuation knob. A slide switch is operable by horizontal movement of the actuation knob between a first state and a second state. In the first state the first and second switch terminals are electrically interconnected and in the second state first and second switch terminals are electrically isolated.

8 Claims, 6 Drawing Sheets

MULTI-FUNCTIONAL CONTROL

CROSS REFERENCE TO RELATED APPLICATION

This application claims the benefit of U.S. Provisional Application No. 60/796,397, filed May 1, 2006, entitled "A Multi-Functional Control", which is hereby incorporated by reference in its entirety.

FIELD OF INVENTION

The present invention relates to a multifunction slide switch and pulse generator assembly that is especially well-suited for use in portable communication devices such as mobile phones and hearing prostheses.

SUMMARY OF THE INVENTION

The invention is a multifunction control that comprises an integrally formed combination of a digital volume control, or electrical pulse generator, and a slide switch that are selectively actuable by an appropriate manipulation of a common actuation knob as illustrated in FIG. 1.

The electrical pulse generator part of the inventive multifunction control is preferably adapted to function according to an electromechanical principle and may be embodied in a number of different forms such as the electrical pulse generators disclosed in U.S. Pat. Nos. 6,943,308, 5,380,965, Danish Patent No. 168258 B1, in addition to U.S. Pat. No. 5,711,415 and EP-A-1455370.

Alternatively, the electrical pulse generator part may operate according to a magneto-electrical principle. According to these embodiments of the invention, the electrical pulse generator part comprises a magnetic field generator coupled to a magneto-electronic sensor. A magneto-electrical pulse generator may, for example, comprise a rotatable permanent magnet assembly mounted in proximity to a set of stationary magnetically sensitive semiconductor devices, which may be disposed in a circular pattern on a substrate member. The magnetically sensitive semiconductor devices may advantageously be operatively coupled to a suitable integrated circuit device that contains voltage or current sensing means and pulse generator circuit adapted to provide electrical pulses in response to a detected rotation of the permanent magnet assembly. The multifunction control preferably comprises at least five externally accessible electrical terminals that may be provided as elongate electrically conductive legs or pins suitable for the soldering of connecting electrical leads. Alternatively, each of the externally accessible electrical terminals may be formed as short and plane electrical contacts suitable for SMD compatible mounting.

The multifunctional assembly in accordance with the present invention saves space on the surface portion of casings of portable communication devices. This advantage is considerable in view of the constant development trend for miniaturization of mobile phones and for hearing prostheses in which the development goes towards smaller and more inconspicuous devices with higher degree of cosmetic appeal to the users.

A particularly advantageous feature of the present invention is that the slide switch portion has been adapted to function with a very small horizontal actuation distance, e.g., the distance of movement from a neutral or default position to the actuated or displaced position of the horizontally displaceable portion of the multifunction control. For hearing prostheses, adaptations of the present invention preferably have a horizontal actuation distance between 0.5 mm and 1.0 mm, such as between 0.6 and 0.8 mm, or even more preferably approximately 0.76 mm.

In a first aspect, the invention relates to a multifunctional switch and impulse generator assembly comprising a base part, an upper part, and a slide switch. The base part encloses an electrical pulse generator. The upper part is rotatable in relation to the base part with an actuation knob. The electrical pulse generator is adapted to provide electrical pulses on one or more externally accessible terminals in response to clockwise and/or counterclockwise rotary motion of the actuation knob. The slide switch is operable by movement of the actuation knob between a first state, wherein a first and a second switch terminal are electrically interconnected, and a second state, wherein the first and the second switch terminal are electrically isolated.

In this context, it is desired that the rotational movement and the sliding movement are performed in at least substantially the same plane, which may be directed in any direction.

The one or more externally accessible terminals receiving the electrical pulses may also be the first and second terminals which are interconnected or isolated. But, it is preferred that these terminals are separated in order to more easily separate the signals generated by rotation and sliding.

In the present context, the terms "electrically isolated or disconnected" is a state clearly distinguishable from the state of being "electrically interconnected." Thus, a larger ohmic resistance, such a resistance larger than 1 mega ohm or preferably larger than 10 or 100 mega ohm, normally exists between the first and second switch terminals in the electrically isolated state compared to the electrically interconnected state. In the latter state, the ohmic resistance between the first and second switch terminals is preferably smaller than 100 ohm, more preferably smaller than 10 ohm or 1 ohm.

In a preferred embodiment, the electrical pulse generator is adapted to provide the electrical pulses when the slide switch is in one of the first and second states and to prevent the providing of electrical pulses when the slide switch is in the opposite state. In that manner, accidental rotation by the user brought about when desiring to actuate the slide switch is ignored. In this context, the opposite state to the first state is the second state and vice versa.

Also, it may be preferred that the upper part comprises a cavity opening facing the base part and having an internal surface, and the base part comprises a rotatable member in operative engagement with the internal surface. As such, the pulse generator is adapted to provide electrical pulses in response to clockwise and/or clockwise rotation of the rotatable member, in one of the first and second states of the slide switch, and disengaged (not engaging the internal surface) in the opposite state of the slide switch, where no pulses are then generated as a result of rotation of the upper part.

In that manner, the rotatable member may be positioned with a rotational axis offset from a rotational/central axis of the internal surface so that sliding of the upper part slides the rotational axis of the upper part closer to the rotational axis of the rotatable member. In this manner, as the rotatable member should engage the internal surface at the position where the axes are more offset (translated), the diameter of the rotatable member is defined. Thus, moving the upper part to a position where the axes are closer to each other will make the distance between the rotatable member and the internal surface larger than the diameter of the rotatable member, and engagement there between may be prevented.

Naturally, the internal surface and the rotatable member may have any desired surfaces, such as smooth surfaces or toothed surfaces. In the last situation, the displacement preferably is sufficient to ensure disengagement of the teeth.

Especially for use in hearing aids and other situations where miniature switches are desired, the slide switch preferably comprises a biasing element maintaining or biasing the slide switch toward/in the first state or the second state. The biasing element has an actuation force, which is the force required to force the biasing element to the opposite state, in the range from about 0.5 N to about 3 N.

In another aspect, the invention relates to a method of operating the multifunctional switch and impulse generator assembly of the first aspect, the method comprises (i) rotating the upper part in relation to the base part so that the electrical pulse generator provides electrical pulses on the one or more externally accessible terminals, and (ii) actuating the slide switch to move from one of the first state and the second state to the opposite state, in order to electrically interconnect or electrically isolate the first and second switch terminals.

In that aspect, preferably the rotating step comprises providing the electrical pulses, when the slide switch is in one of the first and second states, and not providing pulses, when the slide switch is in the opposite state.

Also, it is preferred that the upper part comprises a cavity opening facing the base part and having an internal surface. The base part comprises a rotatable member which, in one of the first and second states of the slide switch, engages the internal surface, and which, in the opposite state of the slide switch, does not engage the internal surface. The rotating step comprises, when the slide switch is in the one of the first and second states, rotating the rotatable member and the pulse generator providing the electrical pulses in response to clockwise and/or clockwise rotation of the rotatable member, and, when the slide switch is in the opposite state, not rotating the rotatable member and the pulse generator not providing pulses.

In addition, preferably, the method further comprises the steps of biasing the slide switch toward one of the first state or the second state, and forcing the slide switch from one of the first and second states to the opposite state by a force in the range from about 0.5 N to about 3 N.

DETAILED DESCRIPTION OF THE INVENTION

Figure 1:
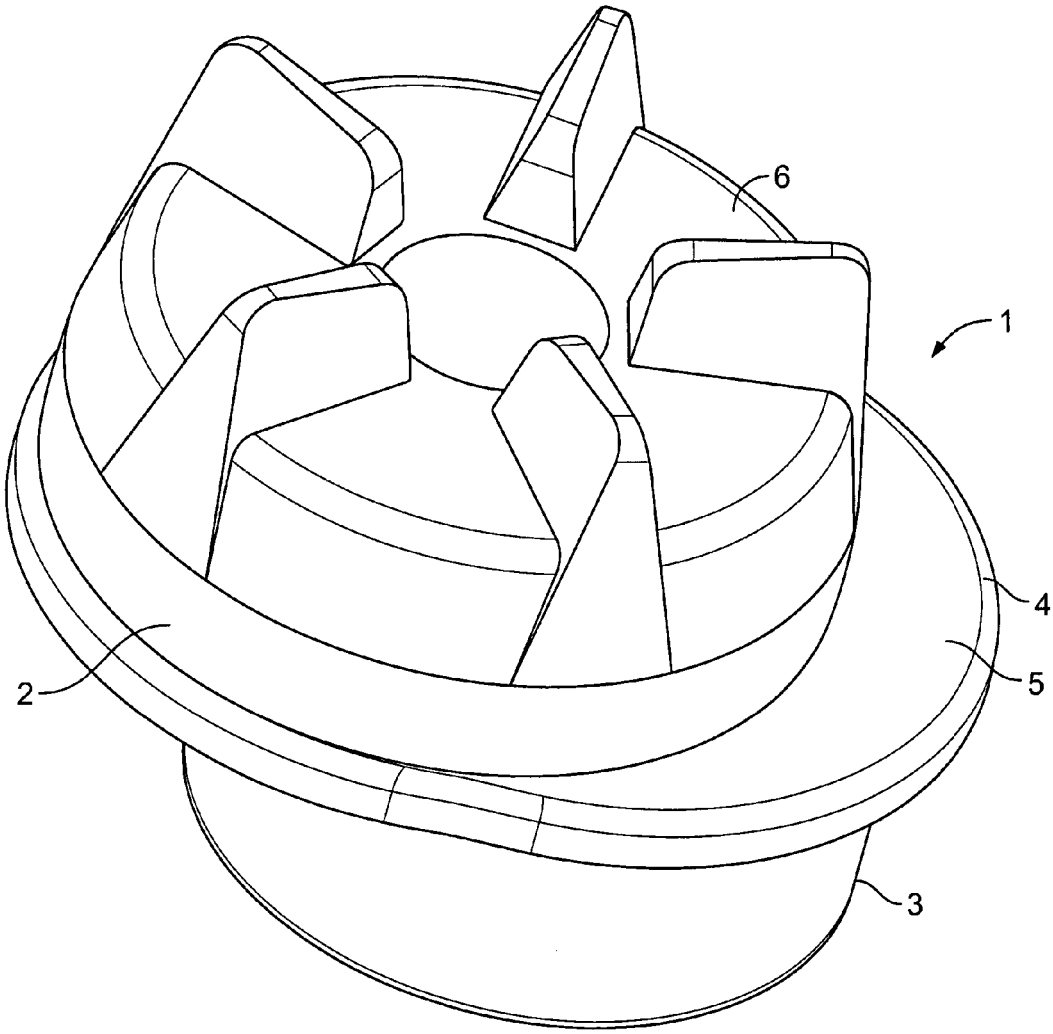
FIG. 1 is a top perspective view of a multifunctional control in accordance with the present invention and comprising an integrally formed combination of an electrical pulse generator and a slide switch.

The multifunction control 1 of FIG. 1 comprises an upper slideably movable portion 2 and a lower housing portion 3 or base which is stationary relative to the housing of the device (e.g., hearing prostheses) into which multifunction control 1 has been incorporated. The base 3 comprises components that form an electromechanical electrical pulse generator. The upwardly oriented end portion of the base 3 comprises elliptical flange 4. The elliptical flange 4 has a substantially plane upper surface 5 and a length larger than diameter of the round upper slideably movable portion 2. The upper slideably movable portion 2 or upper portion comprises a detachable actuation knob 6 with an upper ribbed or corrugated surface for improved grip by the user's finger.

The electrical pulse generator portion of the multifunction control 1 is actuated by imparting a clockwise or counterclockwise rotary motion to the actuation knob 6. The slide switch functionality is actuated by imparting a horizontally-oriented force to the actuation knob 6, e.g., an actuation force along a plane parallel with the substantially plane upper surface 5 of the elliptical flange 4. In the present embodiment of the invention, the slide switch is adapted to function as a momentary switch but other switch functions are naturally also contemplated.

Figure 2:
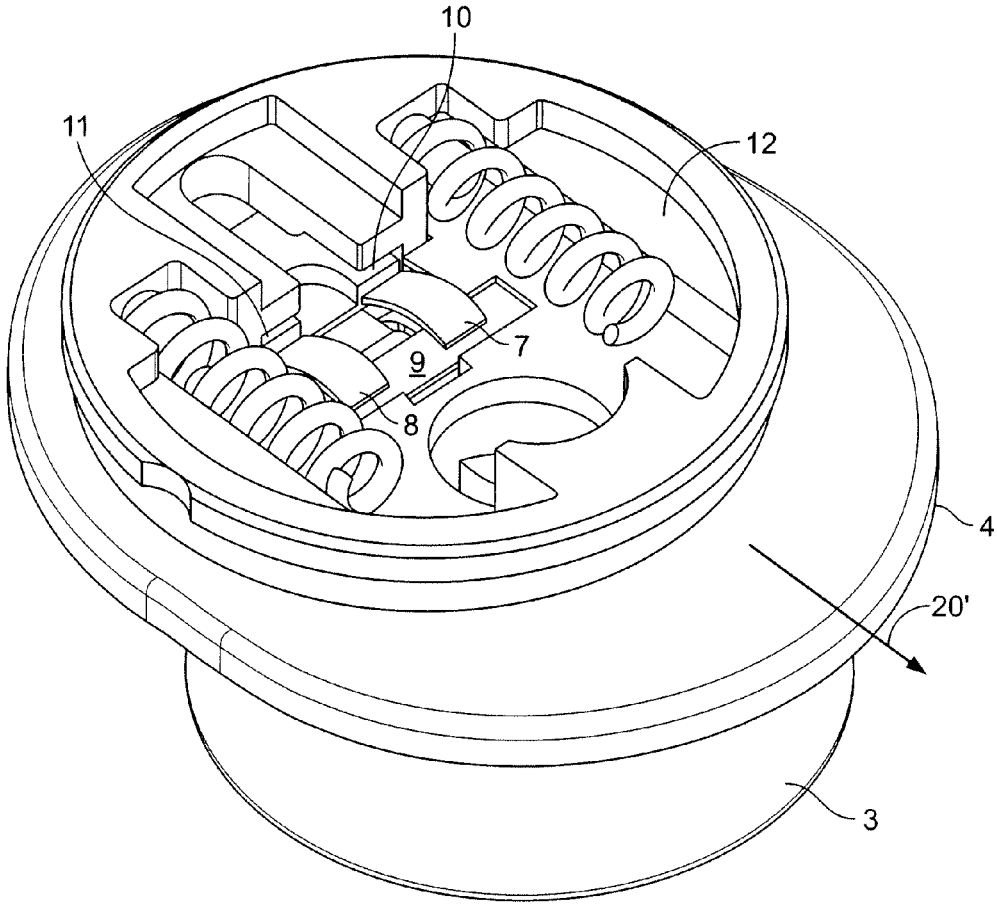
FIG. 2 is a top perspective view of the multifunction control of FIG. 1 in a partially disassembled condition.

The partially disassembled multifunction control 1 in FIG. 2 shows a first and second switch terminals 7, 8, respectively, and electrically conducting contact bar or member 9 that is positioned below the first and second switch terminals 7, 8. These components form the key portions of the slide switch functionality of the present multifunction control. The first and second switch terminals 7, 8 comprises respective bent portions 7', 8' that are bent downwardly in an angle of approximately 90 degrees so as to extend vertically down through the base 3 (as indicated on FIG. 5) and out of the lower housing portion to the exterior of multifunction control 1 in form of first and second externally accessible switch legs 7", 8". During slide switch actuation, the upper portion 2 is horizontally transported as indicated by arrow 20' to bring respective edge portions 10, 11 of an irregularly shaped cutout 12 of the upper portion 2 into contact with the first and second switch terminals 7, 8, respectively. Since first and second switch terminals 7, 8 are made of thin sheets of metallic material, such as palladium silver alloys like Hera649 of Heraeus, and therefore has a spring function, they are bent downwardly when contacted by forward moving respective edge portions 10, 11 and brought into electrical contact with the electrically conducting contact bar 9, preferably made of same material as the first and second switch terminals. Thereby the first and second switch terminals 7, 8, respectively, are momentarily electrically short-circuited and kept in this state until the slide switch is released and returned to its neutral state. Preferably, the actuation force required to actuate the slide switch is set to a value between 0.5 N and 3 N, such as between 0.8 and 1.2 N.

Figure 3:
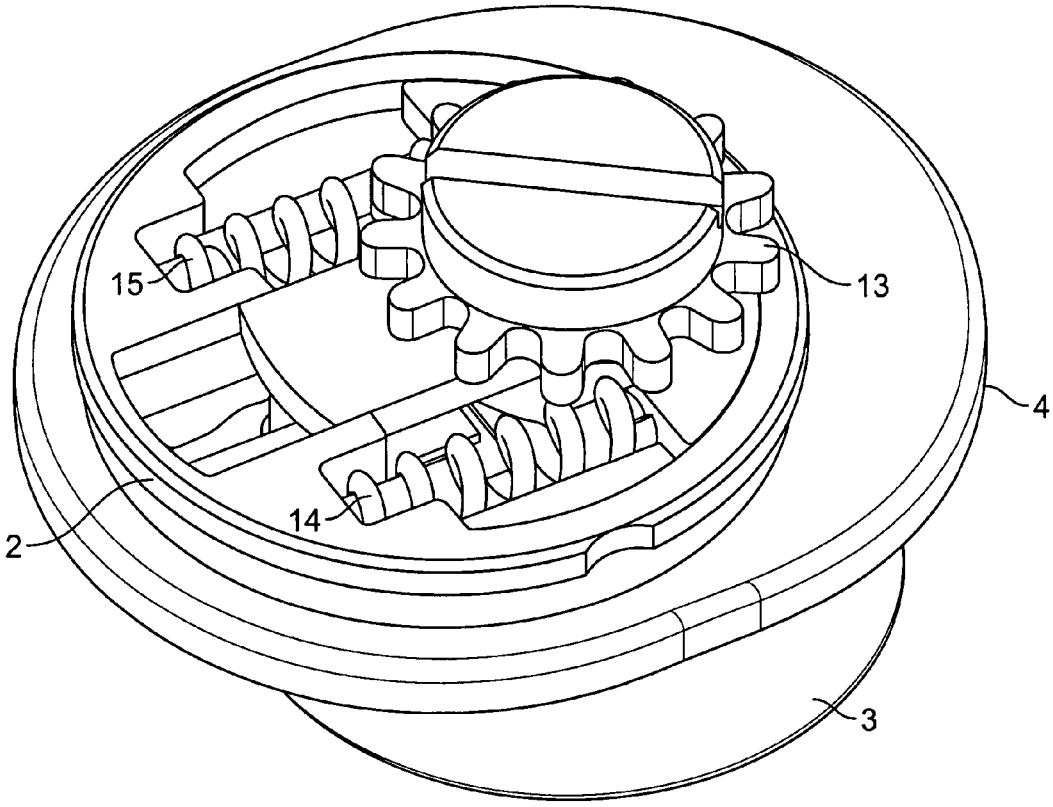
FIG. 3 is a top perspective view of the multifunction control of FIG. 1 in a partially disassembled condition where the horizontally displaceable portion of the multifunction control is in a neutral position to the actuated position of the horizontally displaceable portion of the multifunction control.

Teeth of the gear wheel 13 shown in FIG. 3 are meshed to teeth of a mating or corresponding gear rim 20 placed on the inner peripheral surface of the actuation knob 6 (FIGS. 1 and 5) when the multifunction control 1 is positioned in its neutral or default state. In this default state, the gear wheel 13 and the actuation knob 6 are locked to each other and adapted to move synchronously during rotary movement of the actuation knob 6 to provide the electrical pulse generator functionality of the present device. A vertical axle translates rotary movement of the gear wheel 13 to the electrical pulse generator construction in the base part 3 below. During actuation of the slide switch through the movement of the upper portion or part 2 in horizontal direction, the teeth of the gear wheel 13 and mating teeth of the gear rim inside the actuation knob 6 are automatically brought out of their meshed engaged state. This disengagement is caused by the significantly larger diameter of the gear rim inside the actuation knob 6 than the diameter of the gear wheel 13 which means that only the most frontally situated set of teeth of the gear wheel 13 is actually engaged with the mating set of teeth of the gear rim in the default state of the multifunction control 1.

Figure 4:
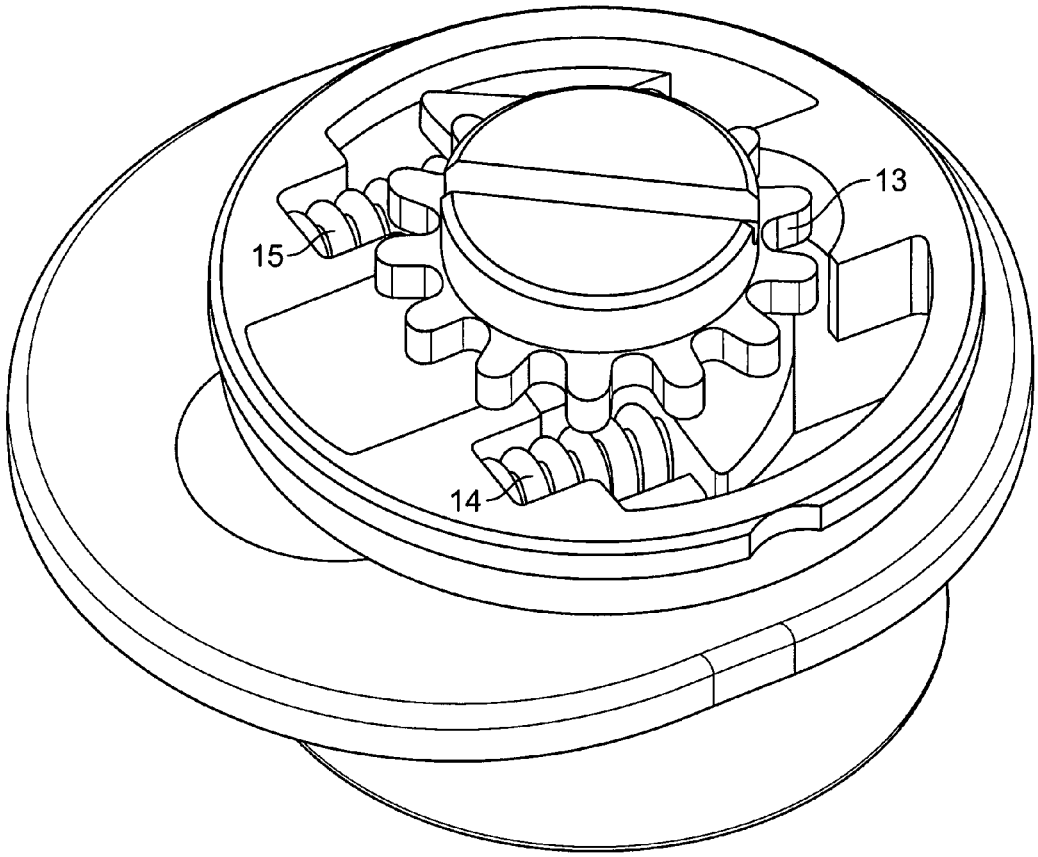
FIG. 4 is a top perspective view of the multifunction control similar to FIG. 3 but illustrating the horizontally displaceable portion of the multifunction control in an actuated position.

FIGS. 3 and 4 illustrate the multifunction control 1 in a default state and an actuated state, respectively. A pair of miniature helical compression springs 14, 15, sets the predetermined actuation force of the slide switch functionality and is responsible for returning the upper portion 2 to its default state after actuation of the slide switch function. The miniature helical compression springs 14, 15 preferably comprise, or are entirely fabricated in, stainless steel. Gear wheel 13 may be fabricated in a variety of different materials such as stainless steel or a plastic compound. The housing is preferably made of an injection moulded polyamide composition.

Figure 5:
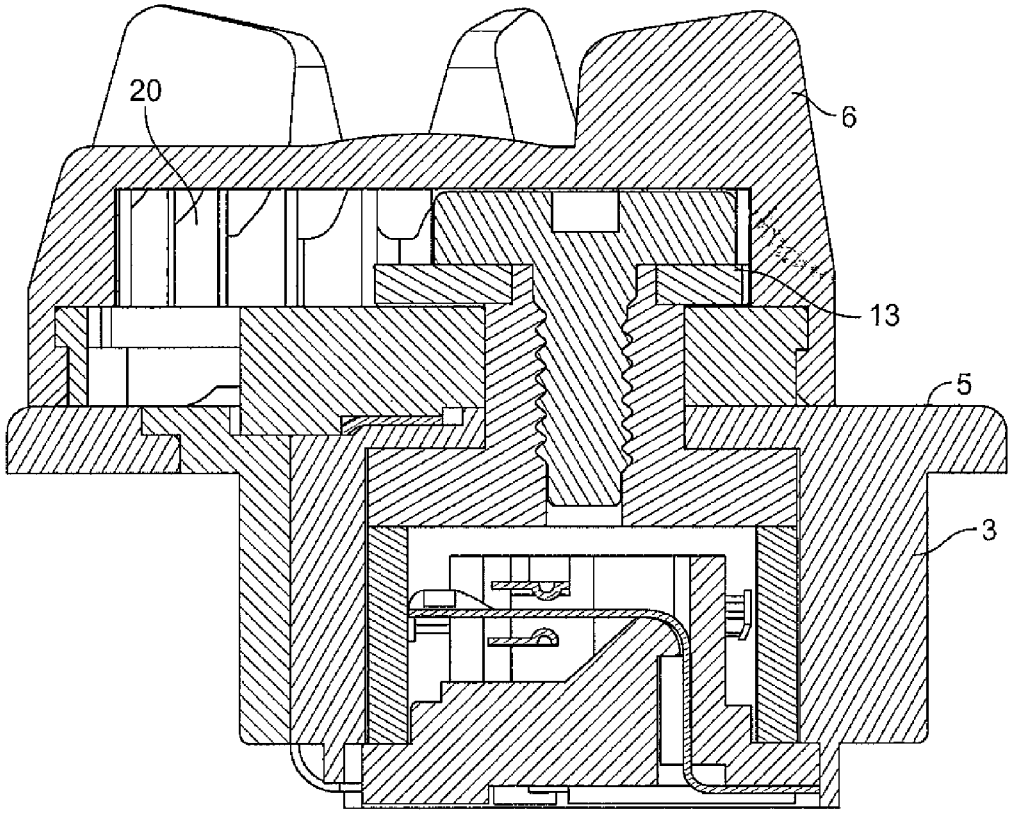
FIG. 5 is a cross-sectional view of the multifunction control of FIG. 1 taken along a vertical central plane of the device.

In the cross-sectional view of FIG. 5, outer dimensions in millimeters [inches] of the multifunction control 1 in accordance with the present embodiment of the invention are shown. The present embodiment is particularly well-adapted for hearing aid applications but naturally one or several dimensions may be adapted to the requirements of any other particular application.

Figure 6:
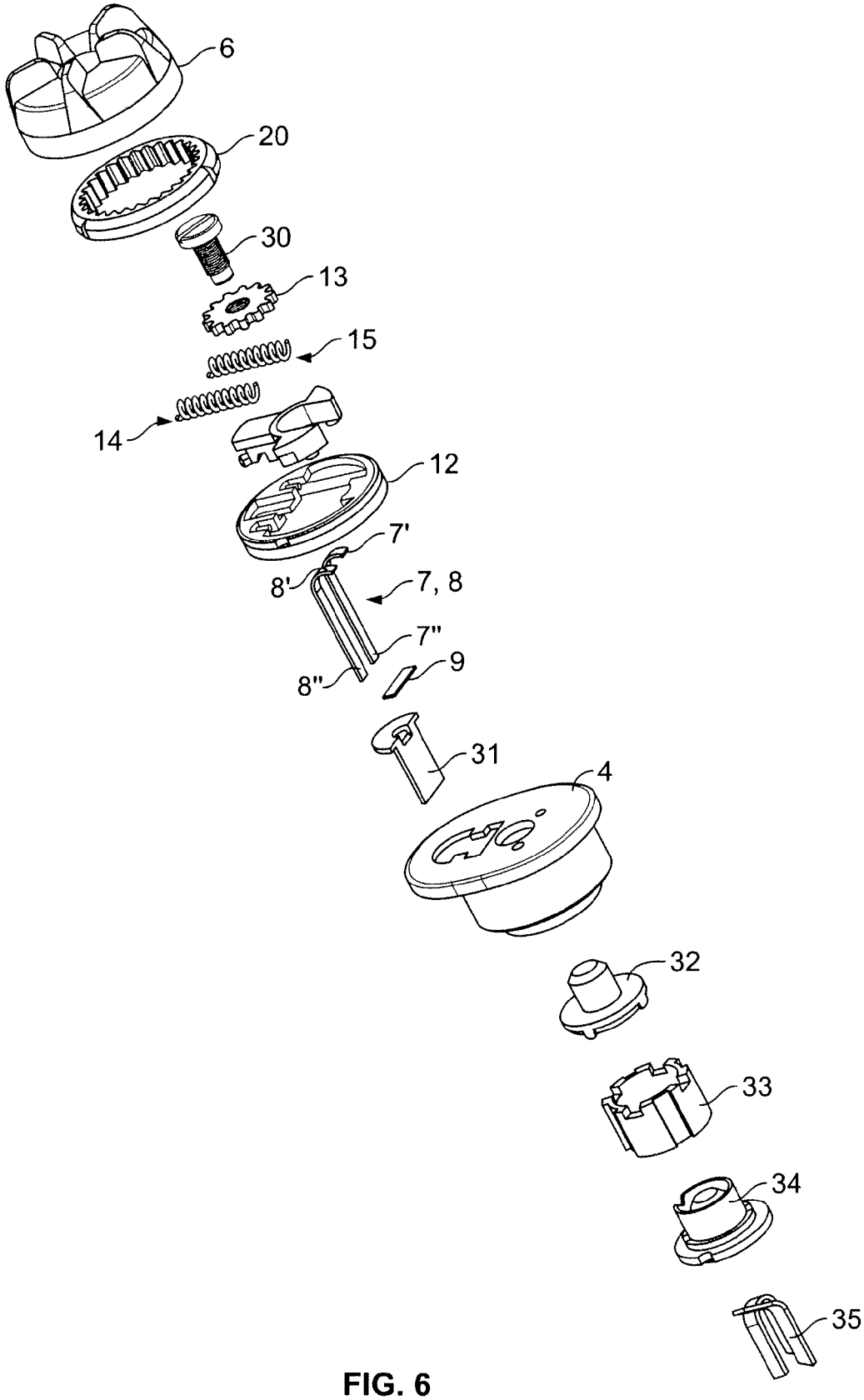
FIG. 6 is an exploded illustration of the multifunction control of FIG. 1.

FIG. 6 is an exploded view wherein the parts or elements 6, 20, 13, 10, 12, 7, 8, 9, and 4 are shown. FIG. 6 illustrates the inner rim 20 of the knob 6, which is formed by a separate element 20 providing the desired surface. FIG. 6 further illustrates elements 30, 31, 32, 33, 34, 35 of the pulse generator in the base 3.

The construction and operation of the actual electrical pulse generator or rotation detector that is enclosed in the base part is described in detail in EP-A-1455370, which is herein incorporated by reference in its entirety.

The invention claimed is:

1. A multifunctional switch and impulse generator assembly, comprising:

a base part enclosing an electrical pulse generator;

an upper part that is rotatable in relation to the base part with an actuation knob, the electrical pulse generator being adapted to provide electrical pulses on one or more externally accessible terminals in response to clockwise and/or counterclockwise rotary motion of the actuation knob; and a slide switch operable by horizontal movement of the actuation knob relative to the base part between a first state, wherein a first and a second switch terminal are electrically interconnected, and a second state, wherein the first and the second switch terminal are electrically isolated, wherein the upper part comprises a cavity opening facing the base part and having an internal surface, and wherein the base part comprises a rotatable member in operative engagement with the internal surface, whereby the pulse generator is adapted to provide electrical pulses in response to clockwise and/or clockwise rotation of the rotatable member, in one of the first and second states of the slide switch and disengaged in the other of the first and second states of the slide switch.

2. The multifunctional switch and impulse generator assembly according to claim 1, wherein the assembly is adapted to provide the electrical pulses when the slide switch is in one of the first and second states and to prevent the providing of electrical pulses when the slide switch is in the other of the first and second states.

3. The multifunctional switch and impulse generator assembly according to claim 1, wherein the slide switch comprises a biasing element maintaining the slide switch in the first state or the second state, the biasing element having an actuation force in the range from about 0.5 N to about 3 N.

4. The multifunctional switch and impulse generator assembly according to claim 1, wherein the horizontal movement corresponds to a horizontal actuation distance between 0.5 mm and 1.0 mm.

5. A method of operating a multifunctional switch and impulse generator assembly having a base part, an upper part, and a slide switch, the base part enclosing an electrical pulse generator, the upper part is rotatable in relation to the base part with an actuation knob, the electrical pulse generator being adapted to provide electrical pulses on one or more externally accessible terminals in response to clockwise and/or counterclockwise rotary motion of the actuation knob, the slide switch is operable by horizontal movement of the actuation knob relative to the base part between a first state, wherein a first and a second switch terminal are electrically interconnected, and a second state, wherein the first and the second switch terminal are electrically isolated, the method comprising:

rotating the upper part in relation to the base part so that the electrical pulse generator provides electrical pulses on the one or more externally accessible terminals; and actuating the slide switch to move horizontally from one of the first state and the second state to the opposite second state, in order to electrically interconnect or electrically isolate the first and second switch terminals, wherein the upper part comprises a cavity opening facing the base part and having an internal surface, and wherein the base part comprises a rotatable member which, in one of the first and second states of the slide switch, engages the internal surface, and which, in the opposite state of the slide switch, does not engage the internal surface, and wherein the rotating step comprises, when the slide switch is in the one of the first and second states, rotating the rotatable member and the pulse generator providing the electrical pulses in response to clockwise and/or clockwise rotation of the rotatable member, and, when the slide switch is in the opposite state, rotating the rotatable member and the pulse generator not providing pulses.

6. The method of claim 5, wherein the rotating comprises providing the electrical pulses in response to the slide switch being in one of the first and second states, and not providing pulses in response to the slide switch being in the other of the first and second states.

7. The method of claim 5, further comprising biasing the slide switch toward one of the first state or the second state, and forcing the slide switch from the one of the first and second states to the opposite state by a force in the range from about 0.5 N to about 3 N.

8. The method of claim 5, wherein the horizontal movement corresponds to a horizontal actuation distance between 0.5 mm and 1.0 mm.

* * * * *